US007269487B2

(12) United States Patent
Watanabe et al.

(10) Patent No.: US 7,269,487 B2
(45) Date of Patent: Sep. 11, 2007

(54) METHOD FOR TRAIN POSITIONING

(75) Inventors: Dai Watanabe, Chiyoda-ku (JP); Kenji Oguma, Chiyoda-ku (JP); Noriharu Amiya, Chiyoda-ku (JP)

(73) Assignee: Hitachi, Ltd., Tokyo (JP)

( * ) Notice: Subject to any disclaimer, the term of this patent is extended or adjusted under 35 U.S.C. 154(b) by 266 days.

(21) Appl. No.: 10/919,211

(22) Filed: Aug. 16, 2004

(65) Prior Publication Data

US 2005/0137760 A1 Jun. 23, 2005

(30) Foreign Application Priority Data

Dec. 19, 2003 (JP) ..... 2003-423179

(51) Int. Cl.
*G06F 17/00* (2006.01)

(52) U.S. Cl. ..... 701/19; 246/122 R; 246/26; 246/34 R; 246/41; 246/58; 701/205

(58) Field of Classification Search ..... 246/170, 246/2 R, 20, 34 A, 122 R, 182 R, 24 A; 701/19, 20, 205
See application file for complete search history.

(56) References Cited

U.S. PATENT DOCUMENTS 4,711,418 A * 12/1987 Aver et al. ..... 246/5
4,768,740 A * 9/1988 Corrie ..... 246/25
4,886,226 A * 12/1989 Frielinghaus ..... 246/121
5,366,183 A * 11/1994 Gill ..... 246/28 R
5,437,422 A * 8/1995 Newman ..... 246/5
5,803,411 A * 9/1998 Ackerman et al. ..... 246/169 R
5,947,423 A * 9/1999 Clifton et al. ..... 246/62
5,954,780 A * 9/1999 Jang ..... 701/93
6,230,085 B1 * 5/2001 Oguma et al. ..... 701/19
6,317,664 B2 * 11/2001 Oguma et al. ..... 701/19
6,371,417 B1 * 4/2002 Southon ..... 246/247

(Continued)

FOREIGN PATENT DOCUMENTS

JP 05-305869 * 11/1993

OTHER PUBLICATIONS

Mirabadi et al; Design of Fault Tolerant Train Navigation Systems; IEEE; Proceedings of the American Control Conference; San Diego; Jun. 1999 pp. 104-108*

(Continued)

*Primary Examiner*—Thomas Black
*Assistant Examiner*—Wae Lenny Louie
(74) *Attorney, Agent, or Firm*—Crowell & Moring LLP

(57) ABSTRACT

In the state that a train moves from a track circuit 3T toward a track circuit 5T, and a train detection signal TD1 is supplied from the boundary between the track circuits 3T and 5T to the track circuits 3T and 5T, and the train detection signal TD1 is received by the train, if the signal intensity is suddenly reduced greatly immediately after the axle of the train passes the boundary between the track circuits 3T and 5T, it can be decided that the train passes the boundary between the track circuits 3T and 5T. Therefore, if absolute position information of the track circuit 5T is preserved beforehand in the train, the movement distance calculated from pulse output of a speed generator is corrected (replaced) in the absolute position information of the track circuit 5T, and hereafter is updated by the pulse output, thus the position of the own train can be easily detected as a movement distance.

7 Claims, 3 Drawing Sheets

U.S. PATENT DOCUMENTS 6,402,094 B1 * 6/2002 Beer ..... 246/122 R
6,470,244 B2 * 10/2002 Oguma et al. ..... 701/19
6,587,763 B2 * 7/2003 Ishikawa ..... 701/19
6,604,031 B2 * 8/2003 Oguma et al. ..... 701/19
6,666,411 B1 * 12/2003 Hart et al. ..... 246/62
2003/0093195 A1 * 5/2003 Ishikawa ..... 701/19

OTHER PUBLICATIONS

Mirabadi et al; Design of Fault Tolerant Train Navigation Systems; IEEE; Proceedings of the American Control Conference; San Diego; Jun. 1999 pp. 104-108.*

* cited by examiner

| TRACK CIRCUIT | SYMBOL SERIES | | |
|---|---|---|---|
| 1T | 1 2 3 4 5 6 | 1 2 3 4 5 6 | 1 2 3 4 5 6 |
| 3T 5T | 2 4 6 1 3 5 | 2 4 6 1 3 5 | 2 4 6 1 3 5 |
| 7T 9T | 3 6 2 5 1 4 | 3 6 2 5 1 4 | 3 6 2 5 1 4 |

METHOD FOR TRAIN POSITIONING

BACKGROUND OF THE INVENTION

1. Field of the Invention

The present invention relates to a method for train positioning of an automatic train control system composed of ground equipment including transponders and track circuits and on-train equipment including an on-train device and a wayside coil loaded on a train and more particularly to a method for train positioning for detecting the position of each of trains as a movement distance by on-train equipment loaded on the train without using balises.

2. Description of Prior Art

The basic object of a signaling safety system of a railroad is to exclusively control incoming into a block section for each train to prevent rear-end collision and derailment of the train. As a conventional signaling safety system, in addition to an interlocking device for interlocking a point and a signal in a station yard, a device for controlling indication on a signal, that is, systems such as various kinds of ATSs (automatic train stop) and ATCs (automatic train control) as a device for deciding an appropriate restricted speed to be indicated to a train are known.

Among those systems, the initial ATS is a simple train stop device, when a train ignores the red signal, for automatically braking. However, as it is improved repeatedly, a function for continuously checking the relationship between the distance up to the stop spot of a train and the speed is provided. On the other hand, with respect to the ATC, the initial one, on the basis of the positions of all trains recognized by the ground equipment, instructs an appropriate restricted speed to each block section, though a recent ATC system is improved so that to each train from the ground equipment, information on the stop position is transmitted and in response to it, each train, on the basis of the roadway conditions and deceleration performance of the own train, executes appropriate deceleration control.

However, in any signaling safety system, to execute appropriate deceleration control, the train side must recognize correctly the position of the own train. To detect the position of the own train, a combination of corrections by a speed generator and balises has been widely used for long. Pulse output from a speed generator is integrated, thus the movement distance of the train is derived continuously and roughly. However, whenever the train passes the balises arranged at appropriate intervals, correct absolute position information is given from each balise, and the preceding movement distance is replaced with the absolute position information, thus an error of the integrated movement distance by the speed generator can be corrected whenever the train passes the balises.

Meanwhile, as a method for detecting the train position by an on-train device without using balises, for example, as disclosed in Japanese Application Patent Laid-Open Publication No. Hei 05-305869 (JP 05-305869 A), although there are faults (although the track circuit section where the own train exists can be detected, the position cannot be corrected, and since an identification symbol is added for each track circuit, a train control signal is long, and the train control period is made longer), a method using an identification symbol for each track circuit is known.

SUMMARY OF THE INVENTION

However, if it is intended to install many balises to enable each train to detect its own position, the labor of the maintenance work is inevitably increased due to the installation thereof and the balises are generally installed over a wide range, so that when the alignment is to be changed (track layout changing) and the signal system is to be changed, re-installation of balises and data re-writing accompanying these changes require enormous expenses.

An object of the present invention is to provide a method for train positioning requiring no balises for train position detection by which each train can detect its own position as a movement distance and a method for train positioning using effectively existing balises not always transmitting absolute position information by which each train can detect its own position as a movement distance.

In the method for train positioning of the present invention, in the state that the absolute position information of each track circuit is held on the train side and by integration of pulse output from the speed generator, the preceding train movement distance is calculated, from changes in the signal intensity of a train detection signal transmitted from each track circuit boundary to the corresponding track circuit which is received by the train side, whenever passing each track circuit boundary is detected, on the basis of the absolute position information of the track circuit immediately after passing, the movement distance is corrected and then updated by the pulse output.

Further, on the train side, the absolute position information of each track circuit is held and by integration of pulse output from the speed generator, the preceding train movement distance is calculated, while on the ground side, in the state that from each track circuit boundary to the corresponding track circuit, a train detection signal of an intrinsic symbol series is transmitted for each track circuit, by changes in the symbol series of the train detection signal which is received and discriminated on the train side, whenever passing the track circuit boundary is detected, on the basis of the absolute position information of the track circuit immediately after passing, the movement distance is corrected and then updated by the pulse output.

Furthermore, in the state that on the train side, the absolute position information of each balise is held and by integration of pulse output from the speed generator, the preceding train movement distance is calculated, whenever the train passes the balises, the information from the balises is received on the train side, and from the receiving time of the information, the movement distance at the receiving time, and the absolute position information of each balise, the balise of the transmission source of the information is decided, and from the absolute position information of the balise, the movement distance is corrected and then updated by the pulse output.

DESCRIPTION OF THE PREFERRED EMBODIMENTS

The embodiment of the present invention will be explained below with reference to FIGS. 1 to 6.

Figure 1:
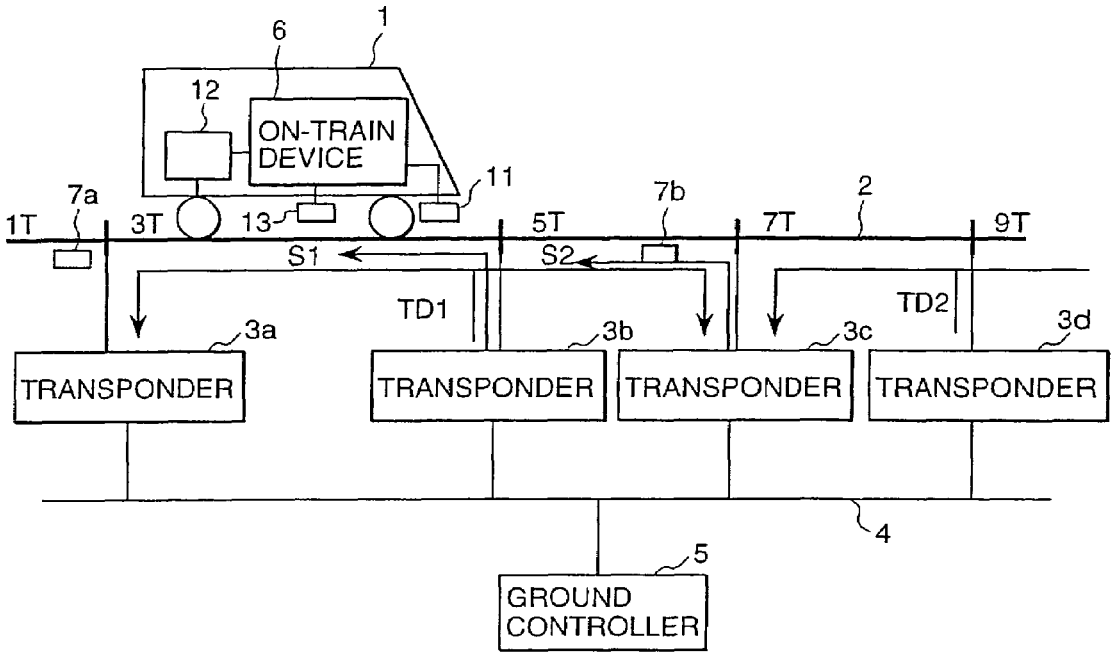
FIG. 1 is a drawing showing the system configuration of an example of the automatic train control system relating to the present invention.

Firstly, the automatic train control system relating to the present invention will be explained. The system configuration which is an example thereof is shown in FIG. 1. As shown in the drawing, on a train 1, an on-train device 6, a receiver 11, a wayside coil 13, and a speed generator 12 are loaded as on-train equipment and among them, the on-train device 6, on the basis of pulse output from the speed generator 12, detects the preceding speeds of the train 1 and the preceding travel distance of the train 1 as an integrated value thereof. Further, the receiver 11 receives train control signals S1 and S2 and train detection signals TD1 and TD2 flowing on the track circuits and then transfers them to the on-train device 6. Furthermore, the wayside coil 13, when the train 1 passes the balises, receives information from the balises and transfers it to the on-train device 6.

On the other hand, with respect to the equipment arranged on the ground, that is, the ground equipment, as shown in the drawing, a track 2 is composed of a plurality of track circuits 1T to 9T, though in this embodiment, jointless track circuits whose track circuit boundaries are jointless are shown. Further, the track circuit boundaries are connected respectively to transponders 3*a* to 3*d* and a train control message and a train detection message transmitted from a ground controller 5 via a network 4 are modulated by the transponders 3*a* to 3*d* and are transmitted to the track circuits as a train control signal and a train detection signal. In the state shown in FIG. 1, the train detection signal TD1 transmitted from the transponder 3*b* is operated so as to be received by the transponders 3*a* and 3*c* and the received result is transferred to the ground controller 5 via the network 4. The ground controller 5, from intensity changes of the received train detection signal TD1, can detect existence on rail of the train 1 on the track circuit.

Further, the ground controller 5, to confirm whether the transmitted train detection message is correctly transmitted from the designated transponder or not, compares the transmitted train detection message with the contents of the received train detection signal and furthermore, the ground controller 5 confirms the position of each train by train detection and to transmit a train control signal to each train, transmits a train control message to a predetermined transponder each time. Meanwhile, to avoid a fixed failure in communication (for example, a fixed failure of the transponder 3*b*), the train detection message must be updated every period.

The outline of the automatic train control system is explained above. Next, a case that the on-train device 6 loaded on the train 1 detects its own position will be explained below.

Figure 2:
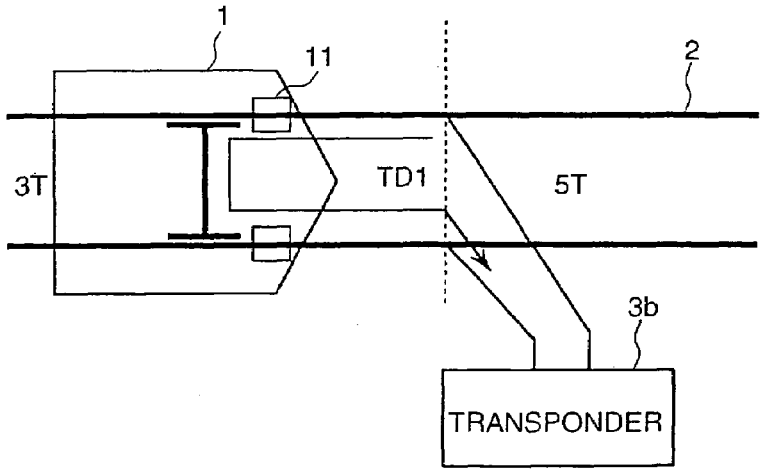
FIG. 2 is a drawing showing the flow of a train detection signal before passing a track circuit boundary.

Namely, the track circuits 3T and 5T and the boundary thereof shown in FIG. 1 are shown on a plane in FIG. 2. As shown in the drawing, it is found that the train detection signal TD1 transmitted from the transponder 3*b* onto the track circuit 3T, since the track 2 is short-circuited by the axle of the train 1 on the track circuit 3T, flows mainly via the axle. Therefore, viewed from the axle, the receiver 11 positioned forward in the route can receive the train detection signal TD1.

Figure 3:
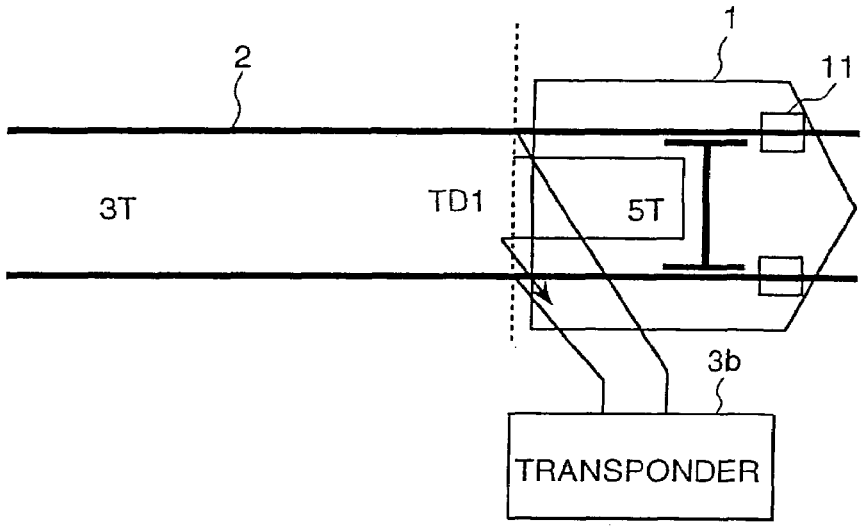
FIG. 3 is a drawing showing the flow of a train detection signal after passing the track circuit boundary.

On the other hand, the state when the train 1 moves further from the state shown in FIG. 2 and incomes into the track circuit 5T is shown in FIG. 3. As shown in the drawing, the train detection signal TD1 transmitted to the track circuit 5T from the boundary between the track circuits 3T and 5T flows mainly via the axle positioned behind the receiver 1, so that the receiver 11 cannot receive the train detection signal TD1. After all, at the point of time when the axle of the train 1 passes the boundary between the track circuits 3T and 5T, the train detection signal TD1 received by the receiver 11 suddenly reduces greatly in the signal intensity thereof.

Figure 4:
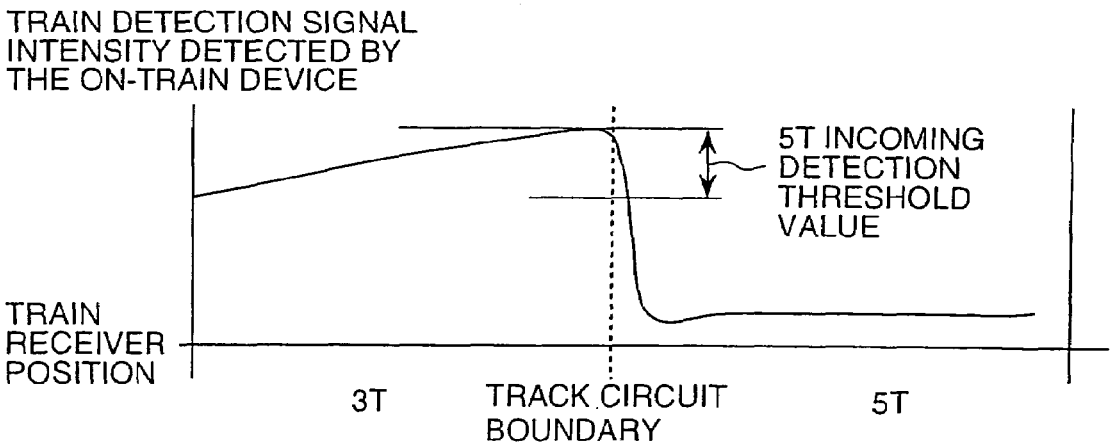
FIG. 4 is a drawing showing changes in the signal intensity of a train detection signal in the neighborhood of the track circuit boundary viewed from an on-train device.

FIG. 4 shows changes in the signal intensity of the train detection signal TD1 viewed from the on-train device 6. As shown in the drawing, it is found that immediately after the axle of the train 1 passes the boundary between the track circuits 3T and 5T, the signal intensity suddenly reduces greatly. Such changes in the signal intensity are seen similarly in the train control signal. Therefore, at the point of time when the change in the reduction direction of the signal intensity exceeds a fixed value (the 5T incoming detection threshold value), it can be decided that the axle of the train 1 passes the boundary between the track circuits 3T and 5T. For example, when the signal intensity of the detected train detection signal TD1 is reduced by 6 dB from the maximum value within the range of less than 20 m, it is decided that the axle of the train 1 passes the boundary between the track circuits 3T and 5T. As mentioned above, in the state that the train side receives the train detection signal or the train control signal, when the signal intensity thereof reduces suddenly, it can be detected that the train passes the track circuit boundary. Therefore, when the absolute position information of each of the track circuits is preserved beforehand in the on-train device 6, if the movement distance calculated from the pulse output from the speed generator 12 is corrected (replaced) in the absolute position information of the track circuit 5T and hereafter, is updated by the pulse output, the position of the own train can be easily detected.

Figures 5, 6:
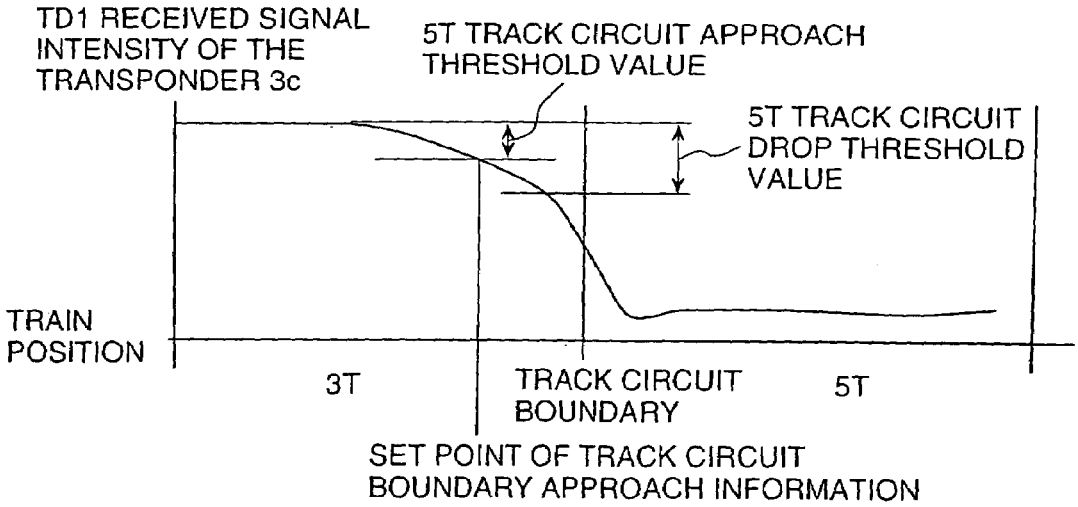
FIG. 5 is a drawing showing an example of a symbol series of a train detection message when the track circuit is detected.
FIG. 6 is a drawing showing changes in the signal intensity of a train detection signal which is received, when a train incomes from a track circuit into another track circuit, by a transponder connected to a track circuit boundary on the far side of the other track circuit.

On the other hand, when a train detection message is set in a different symbol series for each track circuit, thus the on-train device 6 can detect the track circuit on which the train exists, an example of the symbol series is shown in FIG. 5. The symbol series may meet the following two conditions.

To each period, a symbol different for each track circuit is assigned.

Changes of the symbols are intrinsic for each track circuit.

For example, when the symbol series is compared between the track circuits 1T and 3T, the increment of symbols is different. In the symbol series corresponding to the track circuit 1T, the increment is 1 (mod 7), while in the symbol series corresponding to the track circuit 3T, the increment is 2 (mod 7). The reason that the increment before repetition of the period differs is that 7 is eliminated from the symbol series. Therefore, in this case, the symbols in correspondence to at least 3 periods are confirmed, thus the on-train device 6, since the track circuit where the own train exists is identified, can confirm the traveling position of the own train. By doing this, the on-train device 6 can detect the travel section of the own train without using the train control message and there is no need to insert information on the travel section of the train into the train control message. Further, in the same way as with the preceding case, if the movement distance calculated from the pulse output from the speed generator 12 is corrected (replaced) in the absolute position information of the track circuit where the train exists and then is updated by the pulse output, the position of the own train can be easily detected.

Furthermore, as shown in FIG. 1, when the plurality of train control signals S1 and S2 are transmitted onto the track circuits 3T and 5T from the plurality of transponders 3*b* and 3*c*, the on-train device 6 not only can ensure the redundancy of control but also, even when the axle of the train passes the boundary between the track circuits 3T and 5T, can continue to receive at least the train control signal S2, so that the train control can be prevented from interruption.

More concretely, changes in the signal intensity of the train detection signal TD1 received by the transponder 3*c* when the train 1 incomes into the track circuit 5T from the track circuit 3T are shown in FIG. 6. In this case, the track 2 is a jointless track circuit, so that as the leading axle of the train 1 approaches the boundary between the track circuits 3T and 5T, that is, the placing point of the transponder 3*b*, the flow rate of the train detection signal TD1 into the leading axle increases, thus the intensity of a received signal by the transponder 3*c* reduces continuously. The drop decision (detection of existence on rail) of the jointless track circuit, to ensure the margin for the state that the train 1 actually incomes into the track circuit 5T, is set to the 5T track circuit drop threshold value, that is, set so that the axle drops at a higher signal intensity than the short-circuit state right above the placing point (this is referred to as overreach).

The ground controller 5 monitors changes in the signal intensity of a received signal by the transponder 3*c* and at the point of time when the signal intensity reduces from the peak value by an appropriate value (the 5T track circuit approach threshold value), judges that the train 1 approaches the boundary between the track circuits 3T and 5T, and as shown in FIG. 1, transmission of the train control signal S2 from the transponder 3*c* is started. At this time, the train 1 is still under reception of the train control signal S1. Therefore, the on-train device 6, at the point of time when it receives the train control signal S2, can detect that the own train approaches the boundary between the track circuits 3T and 5T and can use the approach information as position correction information of the own train. As mentioned above, even at the time of passing the track circuit boundary, the on-train 6 can receive normally the train control message, so that the continuity of train control is guaranteed. Further, to the on-train device 6, the ground side can transfer information on the traveling position of the train at the timing of transmission start of the train control message from the forward track circuit before receiving the whole frame of the message.

As mentioned above, the position of the own train can be corrected without using balises. However, finally, a case that the position of the own train is corrected by effectively using the existing balises (including balises not always transmitting absolute position information) will be explained below.

Namely, when the train 1 passes balises 7*a* and 7*b*, information from the balises 7*a* and 7*b* can be received by the wayside coil 13. However, when any information is received from the balises 7*a* and 7*b*, the train position is corrected. More concretely, the on-train device 6 almost confirms the position of the own train as a movement distance by integration of the pulse output from the speed generator 12, though the movement distance generally includes not a few errors due to wheelslip, sliding, and other factors.

On the other hand, as shown in FIG. 1, for example, assuming a case that during passing of the train 1 on the track circuit 5T, it passes the balise 7*b*, at the point of time of passing, information from the balise 7*b* is received by the wayside coil 13 and then is transferred to the on-train device 6. However, the on-train device 6 does not recognize the information contents and from the information reception time and the own train position (the movement distance based on the speed generator 12) which is supposed at the reception time, the data base (absolute position information of each of the balises) which is preserved beforehand is retrieved, thus the balise 7*b* having a highest probability of passing of the train 1 in the neighborhood of the passing time can be decided as a transmission source of the information.

Therefore, the on-train device 6 regards the movement distance at the point of time when the train 1 passes the balise 7*b* as absolute position information of the balise 7*b* and from the elapsed time from the passing time and speed changes, the movement distance from the passing time is obtained by the speed generator 12 or theoretically obtained and is added to the absolute position information, thus the train position at the present time can be detected as a movement distance and hereafter the movement distance is updated by the pulse output from the speed generator 12. Therefore, if the similar position correction is executed whenever the train 1 passes each of the balises, accumulation of errors of the movement distance is prevented. As mentioned above, the existing balises, even if they do not transmit absolute position information, do not need to be re-arranged or the data does not need to be reset and they can be used for position correction.

No balises are required for train position detection, and every train can detect its own position, and existing balises not always transmitting position information are effectively used, thus every train can detect its own position.

What is claimed is:

1. A method for train positioning, wherein in a state that absolute position information of each track circuit is held on a train side and by integration of pulse output from a speed sensor, a preceding train movement distance is calculated, from changes in signal intensity of a train detection signal transmitted from each track circuit boundary to its corresponding track circuit which is received by said train side, whenever passing said each track circuit boundary is detected, on the basis of said absolute position information of said track circuit immediately after passing, said movement distance is corrected and then updated by said pulse output.

2. A method for train positioning according to claim 1, wherein to one train, on said track circuits as a jointless track circuit, a train control signal is transmitted from each of said track circuit boundaries, thus on said train side, even during passing said track circuit boundaries, at least one train control signal is received, and train control is continued.

3. A method for train positioning according to claim 2, wherein on a ground side, at the point of time when signal intensity of said train detection signal received from said track circuit on said track circuit boundary or of a train control signal is reduced below a fixed reference value before passing said track circuit boundary, said train control signal is transmitted from a track circuit boundary on a far side of a forward neighboring track, and on said train side, said train control signal from said forward neighboring track is received, thus an approach of said own train to said track circuit boundary is detected.

4. A method for train positioning, wherein on a train side, in a state that absolute position information of each track circuit is held and by integration of pulse output from a speed sensor, a preceding train movement distance is calculated, while on a ground side, in a state that from each track circuit boundary to its corresponding track circuit, a train detection signal of an intrinsic symbol series is transmitted for each track circuit, by changes in said symbol series of said train detection signal which is received and discriminated on said train side, whenever passing said track circuit boundary is detected, on the basis of said absolute position information of said track circuit immediately after passing, said movement distance is corrected and then updated by said pulse output.

5. A method for train positioning according to claim 4, wherein to one train, on said track circuits as a jointless track circuit, a train control signal is transmitted from each of said track circuit boundaries, thus on said train side, even during passing said track circuit boundaries, at least one train control signal is received, and train control is continued.

6. A method for train positioning according to claim 5, wherein on said ground side, at the point of time when signal intensity of said train detection signal received from said track circuit on said track circuit boundary or of a train control signal is reduced below a fixed reference value before passing said track circuit boundary, said train control signal is transmitted from a track circuit boundary on a far side of a forward neighboring track, and on said train side, said train control signal from said forward neighboring track is received, thus an approach of said own train to said track circuit boundary is detected.

7. A method for train positioning, wherein in a state that absolute position information of each balise is held on a train side and by integration of pulse output from a speed sensor, a preceding train movement distance is calculated, whenever said train passes said balises, said information from said balises is received on said train side, and from a receiving time of said information, said movement distance at said receiving time, and said absolute position information of said each balise, a balise of a transmission source of said information is decided, and from said absolute position information of said balise, said movement distance is corrected and then updated by said pulse output.

* * * * *